US005092006A

United States Patent [19]

Fogel

[11] Patent Number: 5,092,006

[45] Date of Patent: Mar. 3, 1992

[54] NON-ELECTRICAL REVERSIBLE THERMAL CUSHION FOR A MATTRESS OR OTHER BODY SUPPORT SURFACE

[76] Inventor: Isaac Fogel, 8214 Wellmoor Ct., Jessup, Md. 20794

[21] Appl. No.: 568,733

[22] Filed: Aug. 17, 1990

[51] Int. Cl.[5] ..... A47C 27/08

[52] U.S. Cl. ..... 5/448; 5/451; 5/473; 5/484; 5/502

[58] Field of Search ..... 5/420–422, 5/448, 451, 459, 462, 470, 473, 478, 481, 483, 484, 502

[56] References Cited

U.S. PATENT DOCUMENTS

| | | | |
|---|---|---|---|
| 3,702,434 | 11/1972 | Tobinick et al. . | |
| 4,015,299 | 4/1977 | Tinnel | 5/451 |
| 4,145,781 | 3/1979 | Autrey et al. . | |
| 4,186,455 | 2/1980 | Fox, Jr. et al. . | |
| 4,187,566 | 2/1980 | Peterson . | |
| 4,187,567 | 2/1980 | Crowther . | |
| 4,221,013 | 9/1980 | Echevarria . | |
| 4,245,361 | 1/1981 | Evanson . | |
| 4,326,310 | 4/1982 | Frankenberg | 5/459 X |
| 4,357,725 | 11/1982 | Ahlm | 5/473 X |
| 4,449,261 | 5/1984 | Magnusson . | |
| 4,476,593 | 10/1984 | Fanselow et al. | 5/421 X |
| 4,549,323 | 10/1985 | Brockhaus | 5/502 X |
| 4,602,396 | 7/1986 | Fraige | 5/470 X |
| 4,637,947 | 1/1987 | Maekawa et al. | 5/459 X |
| 4,656,681 | 4/1987 | Alexander et al. | 5/451 |
| 4,658,452 | 4/1987 | Brockhaus | 5/420 |
| 4,754,514 | 7/1988 | Limb et al. . | |

FOREIGN PATENT DOCUMENTS

| | | | |
|---|---|---|---|
| 2916110 | 10/1980 | Fed. Rep. of Germany | 5/421 |
| 3333707 | 8/1984 | Fed. Rep. of Germany | 5/459 |
| 2431271 | 3/1980 | France | 5/502 |

*Primary Examiner*—Michael F. Trettel
*Attorney, Agent, or Firm*—Finnegan, Henderson, Farabow, Garrett & Dunner

[57] ABSTRACT

A reversible thermal cushion includes a resilient layer; an insulating layer adjacent the resilient layer, the insulating layer having a reflective surface facing away from the resilient layer; and a PVC top sheet and bottom sheet for containing the resilient layer and the insulating layer. The resilient layer is made from polyurethane foam having a density of at least 1.8 lbs./ cubic foot, and has a convoluted surface on at least one side. The reflective surface is aluminum vacuum deposited on one side of a polyethylene film laminated to polyurethane foam.

4 Claims, 4 Drawing Sheets

NON-ELECTRICAL REVERSIBLE THERMAL CUSHION FOR A MATTRESS OR OTHER BODY SUPPORT SURFACE

FIELD OF THE INVENTION

The present invention relates to a non-electrical reversible thermal cushion, and more specifically, to a reversible thermal cushion which covers, rests on, or rests inside a mattress or other body support surface or system.

DESCRIPTION OF THE RELATED ART

There is a growing demand in the marketplace for waterbeds. Dealers and consumers are concerned about safety of electric heaters that are sometimes placed in these waterbeds. A further concern is the recent disclosure of potential health hazards related to electromagnetic field radiation generated by the electric resistance heaters used in waterbeds. Additionally, it is desirable to avoid the energy costs associated with the electricity required to operate the heater.

An unheated waterbed poses two major problems. First, the water fill of the waterbed will settle to the ambient temperature of the room. At a typical room temperature of 70° to 72° F., a waterbed, because of its relatively high specific heat, will draw body heat to the point that a person in the bed will become uncomfortably cold, and in the case of aged or debilitated users can cause hypothermia.

Secondly, moisture in the air will condense on the surface of the mattress if it is at or below the dew point temperature. The dew point temperature near the mattress tends to be high because of the combination of environmental conditions and water vapor emitted by persons sleeping on the bed. Condensation, once formed, tends to buildup making the sheets and bedding feel damp and clammy. In extreme cases, the condensation builds enough to seep between the mattress and the walls of the frame, where it cannot rapidly evaporate and thus creates conditions for growth of mildew and odors.

Prior attempts have been made to solve these problems. These attempts have not been altogether successful, because of condensation problems or the inability of the insulation to breath thus causing ballooning of the mattress. Other attempts to solve the problem have resulted in quilting or laminating insulation material into the mattress cover. However, quilting results in many needle holes which allow moisture to permeate the insulation layer. Quilting or laminating also results in making the thermal surface non-reversible and thus the users cannot alter its thermal characteristics. Therefore, it is desirable to provide an improved thermal cover for an unheated waterbed mattress and other support surfaces where warmth is desired.

Innerspring, foam and air mattresses are not capable of being heated in the same way as a waterbed mattress. Primarily, users of such mattresses rely on electric blankets for heating. Electric blankets, while consuming less power than a waterbed mattress heater, can present problems such as overheating, electric shock and energy costs, and also produce an electromagnetic field. Therefore, it is also desirable to have a reversible thermal cushion to cover these types of mattresses.

SUMMARY OF THE INVENTION

It is an object of the invention to provide an improved reversible thermal cushion for various sleeping and seating surfaces. It is a further object of the invention to provide a reversible thermal cushion for a waterbed mattress, and a cushion which does not promote condensation.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

In accordance with the invention, as embodied and broadly described herein, a reversible thermal cushion comprises a resilient layer; a reflective surface; and means for containing the resilient layer and the reflective surface.

In a preferred embodiment, the resilient layer comprises polyurethane foam, and the foam is convoluted on at least one side. Preferably, the polyurethane foam has a density of at least 1.8 lbs./cubic foot. Further preferably, the reflective surface comprises metal vacuum deposited on one side of a polyethylene film laminated to a polyurethane layer. Also, the retaining means is preferably impervious to water.

It is to be understood that both the foregoing general description and the following detailed description are exemplary and explanatory only, and are not restrictive of the invention as claimed.

BRIEF DESCRIPTION OF THE DRAWINGS

The accompanying drawings, which are incorporated in and constitute a part of the specification, illustrate several embodiments of the invention and together with the description, serve to explain the principles of the invention.

DETAILED DESCRIPTION OF THE PREFERRED EMBODIMENT

Reference will now be made in detail to the presently preferred embodiments of the invention, examples of which are illustrated in the accompanying drawings. Wherever possible, the same reference numbers will be used throughout the drawings to refer to the same or like parts.

A typical waterbed includes a frame, water bladder or cylinders and ticking cover. The frame may either be a soft-side frame, e.g., one made of foam, or a hard-side frame, e.g., one made of wood.

Figure 1:
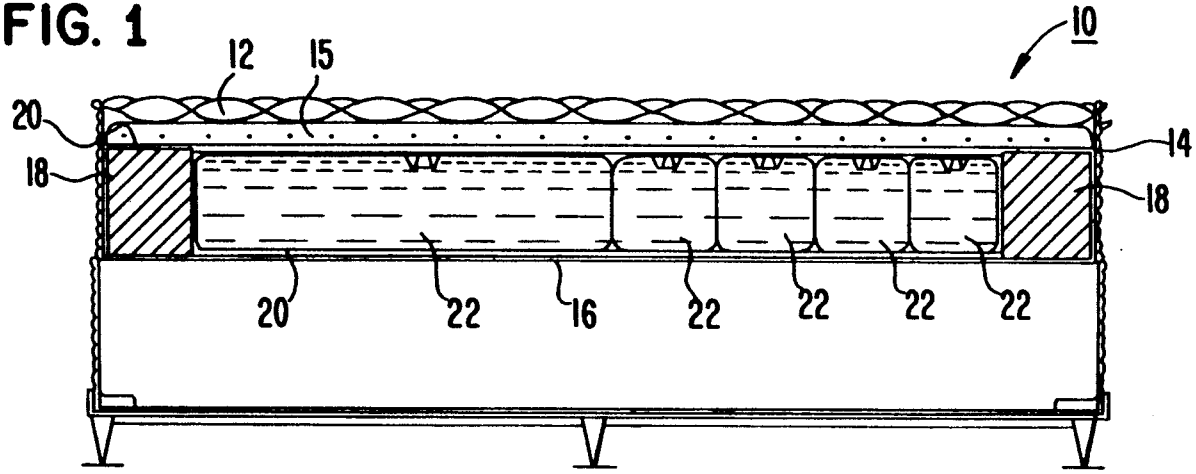
FIG. 1 depicts a typical soft-side waterbed incorporating the invention.

FIG. 1 depicts a typical soft-side waterbed 10. The top ticking panel 12 may be quilted with a combination of fiber or foam. Ticking panel 12 is disposed with a mating zipper sewn into its perimeter. The mattress has a lightly quilted side wall 14 which has a mating zipper half sewn in its perimeter. Side wall 14 is fixed to a bottom sheet 16 of fabric which underlies the entire upper structure. Foam walls 18 provide outer side structure for the mattress. A safety liner 20 of PVC sheeting fits within the cavity of the frame and overwraps the top and outer surfaces of the foam walls. Bladders or cylinders 22 hold water, and are adjustable in firmness by increasing and decreasing the amount of water held therein. According to the invention, reversible thermal cushion 15 is located between bladders 22 and ticking panel 12. Cushion 15 extends to cover both water bladders 22 and foam walls 18, and prevents a person lying on the bed from feeling a difference in support at the location where the bladders and the foam come together.

Figure 2:
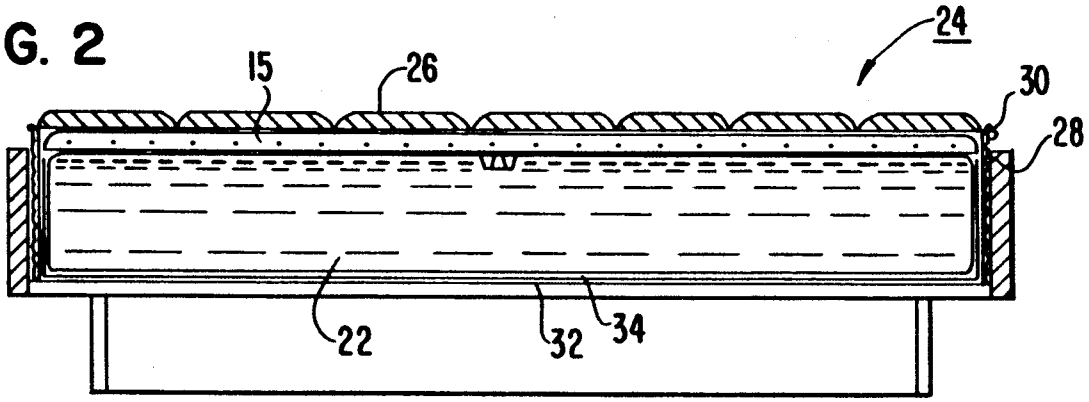
FIG. 2 depicts a typical hard-side waterbed incorporating the invention.

FIG. 2 depicts a typical hard-side waterbed 24. In this case, a quilted ticking panel 26 holds in place a reversible thermal cushion 15 according to the invention. The quilted ticking panel 26 and side wall 28 of the unit have mating zipper 30 permitting easy access to water bladder 22. Boarder walls 28 of the cover are sewn into fabric bottom 32 which underlies the entire system. A safety liner 34 is designed to catch and hold water contents of the mattress in the event of any leakage.

Figure 3:
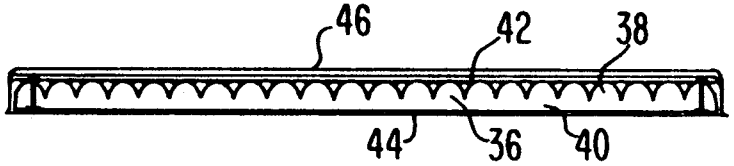
FIG. 3 depicts one embodiment of a reversible thermal cushion of the present invention.

In accordance with the invention, a reversible thermal cushion includes a resilient layer. As embodied herein and shown in FIG. 3, reversible thermal cushion 15 has resilient layer 36 preferably made of polyurethane foam. However, resilient layer may be made of other materials, such as fibers, springs and cotton, as known in the art.

Figure 4:
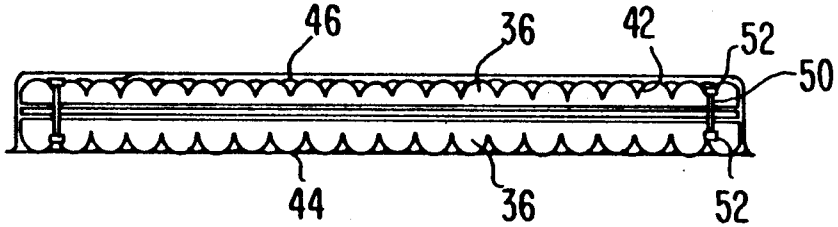
FIG. 4 depicts a second embodiment of a reversible thermal cushion of the present invention.

Preferably, the polyurethane foam of the resilient layer has a density of at least 1.8 lbs. per cubic foot, and an indention load deflection of not more than 30 lbs. The foam is preferably at least 1.5 inches thick and has a convoluted surface with fingers 38 on one side. Preferably, base section 40 is 0.75 inches thick and fingers 38 are 0.75 inches long. A further preferred embodiment is shown in FIG. 4, the cushion may has a 3-inch layer of foam with a convoluted surface on both sides. The 3-inch foam layer may be made by putting two 1½ inch foam sections 36 back to back.

In accordance with the invention, a reversible thermal cushion includes an insulating layer. As embodied herein and shown in FIG. 3, the insulating layer 42 comprises a polyethylene film which has aluminum (or other reflective material) vacuum deposited on one side of the film. The film is preferably 0.0025 inches thick. The coated side of the polyethylene film is laminated to a layer of polyurethane foam of between ⅛ inch and 1/16 inch in thickness. The preferable method of laminating is by adhesive. Insulating layer 42 thereby created has the advantage of being flexible, not making "crinkling" or other noises, and preventing bunching, tearing, stretching and breaking when a person lies thereon. Insulating layer 42 is arranged next to the resilient layer 36 such that the reflective surface (i.e., the polyethylene) faces away from the resilient layer.

In the 3-inch resilient layer embodiment shown in FIG. 4, the insulating layer 42 may be sandwiched between the two 1½ inch foam sections. Alternatively, insulating layer 36 may be located next to the resilient layer such that the reflective surface faces away from the resilient layer, as in the 1½ inch foam embodiment.

A reversible thermal cushion of the invention can, in cold weather, be arranged such that the reversible thermal cushion is placed with the reflective surface facing a person lying on the bed. So placed, the reversible thermal cushion reflects the person's body heat back toward him or her, and increases the temperature of the area around the person by 2°–4° F. as compared with no reversible thermal cushion. In addition to warming the person, this temperature increase makes condensation less likely. In warm weather, the cushion may be turned over so that the reflective layer does not reflect heat back toward the person on the bed.

In accordance with the invention, the reversible thermal cushion has means for containing the resilient layer and the insulating layer. As embodied herein the containing means includes two polyvinyl chloride ("PVC") sheets 44 and 46 of preferably 8–10 mil. gauge. These sheets are dialectrically heat sealed to each other around the entire perimeter, as known in the art. The PVC sheets have the added advantage of providing a two-layer water and moisture barrier between a person lying on the mattress and the water bladder. If such water barrier is not necessary or desired, then the containing means may be made out of other materials known in the art, such as cloth made of natural or synthetic fiber.

Figure 5:
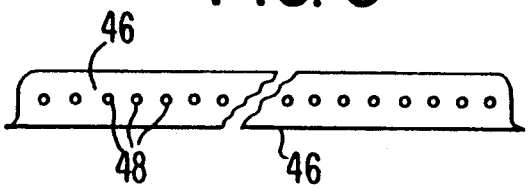
FIG. 5 depicts a containing cover of the present invention.

Preferably, as shown in FIG. 5, holes 48 of ¼-inch diameter are provided in the PVC sheets to allow layers 36 and 42 to breathe. These holes also allow air to escape and prevent the containing means from ballooning when a person lies on the reversible thermal cushion. Commercially available breather buttons can be substituted for holes 48.

The cushion may also have means for maintaining alignment of the insulating layer and the resilient layer comprising plastic or aluminum rivets 50 and washers 52 (shown in FIG. 3 and 4) located about the perimeter of the convoluted foam panels and the insulating layer to keep those layers in alignment. Other alignment maintaining means can be used such as laminating and tying the layers together.

Figure 6:
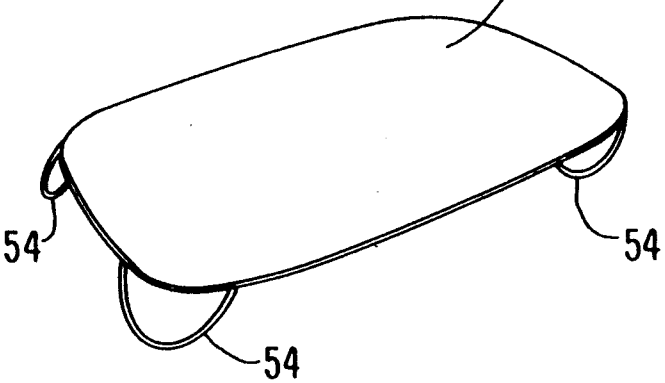
FIG. 6 depicts a third embodiment of the present invention adapted for conventional mattresses.

The reversible thermal cushion of the invention may be adapted to provide a removable cushion for a mattress. Such a cushion is shown in FIG. 6. In this embodiments, cushion 15 is preferably fitted with corner attachments such as elastic straps 54 which can be placed around the corners of, for example, an innerspring, air or foam mattress.

Figure 7:
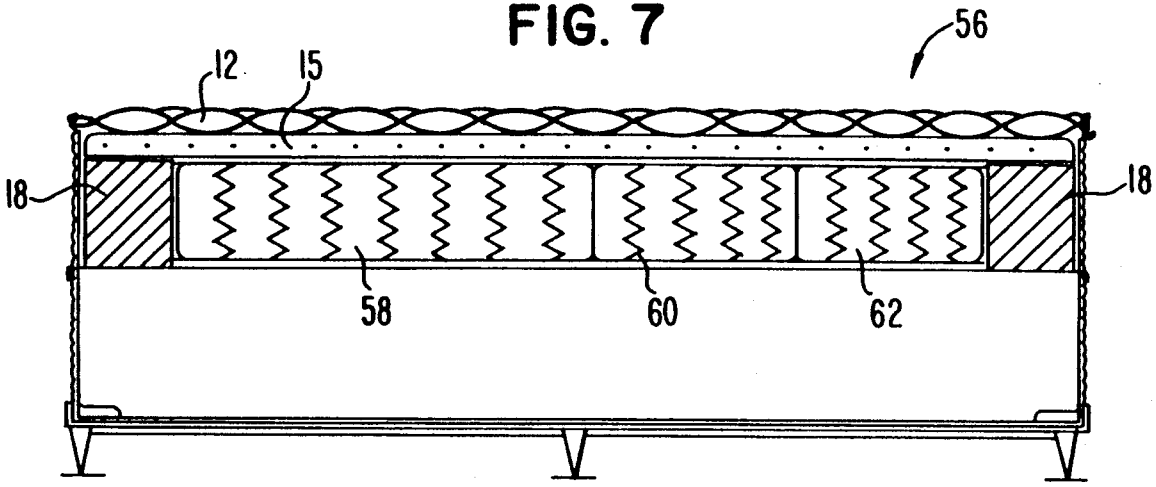
FIG. 7 depicts a variable innerspring-insert mattress using the invention.

The reversible thermal cushion of the invention may be incorporated into various other kinds of bedding. FIG. 7 shows reversible thermal cushion in a novel innerspring insert mattress 56. Ticking panel 12 covers an reversible thermal cushion 15 according to the invention. Foam walls 18 provide a support frame for innerspring inserts 58, 60 and 62. These inserts may be designed to have different levels of firmness. By exchanging one insert for another one of different firmness, a user can vary the firmness of the mattress in different areas. Foam, air, cotton, and other resilient materials known in the art may be substituted for the springs in inserts 58, 60, and 62.

Figure 8:
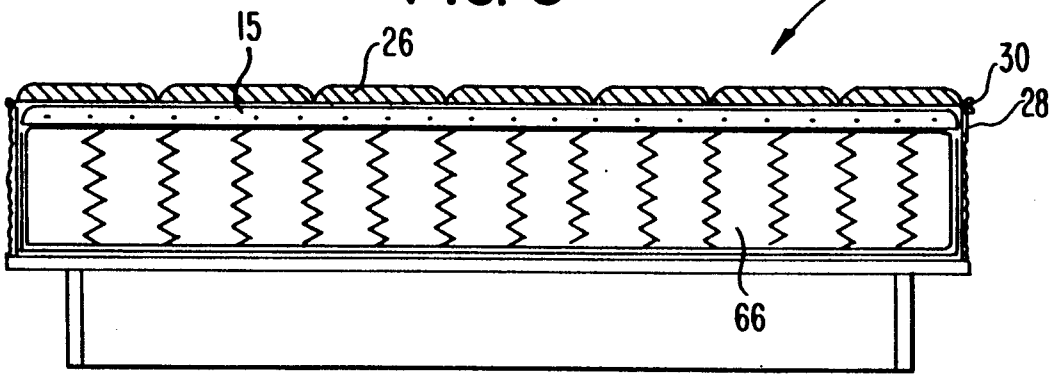
FIG. 8 depicts conventional innerspring mattress incorporating the invention.

FIG. 8 shows a reversible thermal cushion according to the invention used in a conventional innerspring mattress 64. Quilted panel 26 and lightly quilted sidewalls 28 form a cover for the innerspring system 66.

Reversible thermal cushion 15 is placed above the springs. Access to the inside of mattress 64 may be provided by zippers 30. Cushion 15 can be reversed by accessing the cushion using zipper 30, or the entire mattress may be reversed if both the top and bottom surfaces are quilted. In a mattress of this type foam, air, cotton, and other resilient materials known in the art may be substituted for the springs.

Figure 9:
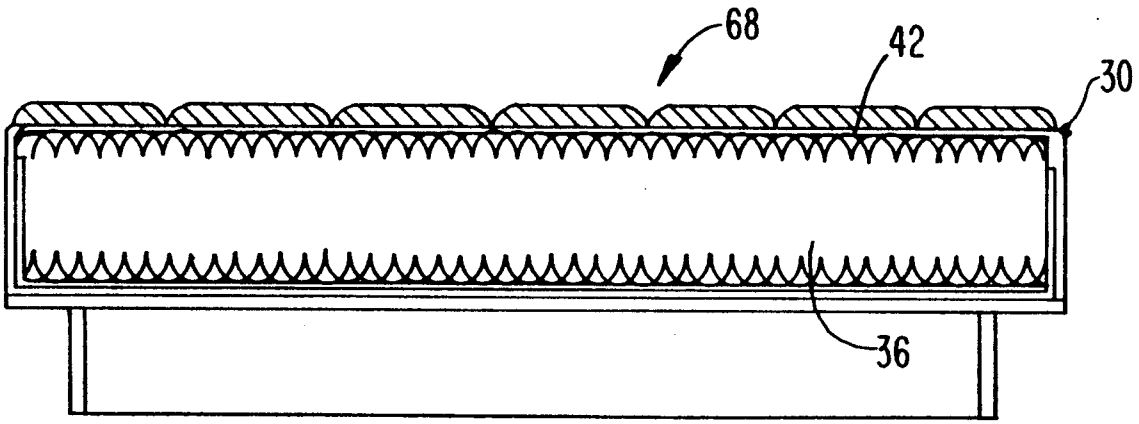
FIG. 9 depicts a foam mattress according to the invention.

FIG. 9 depicts a thermal mattress 68 according to the invention. Thermal mattress 68 is similar to the reversible thermal cushion of the invention. Resilient layer 36 is made from polyurethane foam. Preferably, the foam is convoluted on both the top and bottom surfaces. Further preferably, the foam is approximately 5 inches thick. Insulating layer 42 is located adjacent to the foam layer. The foam layer and the insulating layer are contained together as a unit. In order to vary the thermal characteristics of the mattress zipper 30 can be used to access the mattress, and resilient layer 36 and foam layer 42 may be reversed, or the entire mattress may be reversed if both the top and bottom surfaces are quilted, so that the reflective surface of the insulating layer faces away from a person lying on the bed.

A reversible thermal cushion as described above in connection with a waterbed mattress may be used in a variety of applications such as innerspring mattresses, foam mattresses, air mattresses, futons, sitting surfaces, back cushions, headrests, sleeping bag inserts, blankets, recliners with heat and massage units, shoe inserts, carpet underlaying, chairs, stadium cushions, motion furniture, sleep sofas, hideaway beds, and medical mattresses.

It will be apparent to those skilled in the art that various modifications and variations can be made in the reversible thermal cushion of the present application and in the construction of this cushion without departing from the scope or spirit of the invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A mattress for supporting a person at a predetermined location, the mattress comprising:

at least one resilient section of the type selected from innerspring, foam, air or cotton;

a frame capable of supporting the resilient section;

a reversible thermal cushion between the resilient section and the location where the person is to be supported, the cushion including a resilient layer, an insulating layer including a metal layer on a plastic layer, the plastic layer being laminated to a polyurethane foam layer, and means for containing the resilient layer and the insulating layer; and a ticking layer between the reversible thermal cushion and the location where the person is to be supported.

2. The waterbed mattress as claimed in claim 1, wherein the frame is a soft-side frame having foam walls surrounding the resilient section, and wherein the reversible thermal cushion extends to cover both the resilient section and the foam walls.

3. A reversible thermal cushion comprising:

a resilient layer comprising foam, the foam being convoluted on at least one side;

a reflective layer; and means for containing the resilient layer and the reflective layer, said means being impervious to water, wherein the side of the foam which is convoluted faces the reflective layer.

4. A reversible thermal cushion comprising:

a resilient layer;

a reflective layer comprising metal vacuum deposited on one side of a polyethylene film, wherein the side of the polyethylene film away from the vacuum deposited metal is laminated to polyurethane foam; and means for containing the resilient layer and the reflective layer, said means being impervious to water.

* * * * *